US006035576A

United States Patent [19]

Bozeman

[11] Patent Number: 6,035,576

[45] Date of Patent: Mar. 14, 2000

[54] APPARATUS WITH BASEPLATE FOR SUPPORTING A PLANT CONTAINER

[76] Inventor: Lee Bozeman, 9498 Edson Rd., Capron, Ill. 61012

[21] Appl. No.: 09/040,718

[22] Filed: Mar. 18, 1998

[51] Int. Cl.[7] ..... A01G 17/06

[52] U.S. Cl. ..... 47/47

[58] Field of Search ..... 47/25, 43, 44, 47/46, 42, 47, 20, 21, 23, 24; 248/545, 530, 156, 230.8, 351, 346.03, 346.01

[56] References Cited

U.S. PATENT DOCUMENTS

| | | | |
|---|---|---|---|
| 2,039,779 | 5/1936 | Cote | 248/38 |
| 2,426,443 | 8/1947 | Fetterman | 47/47 |
| 2,554,887 | 5/1951 | Tricarico | 248/44 |
| 4,753,411 | 6/1988 | Lechner et al. | 248/533 |
| 5,065,975 | 11/1991 | Giles | 248/545 |
| 5,094,422 | 3/1992 | Tiffany | 248/519 |
| 5,123,623 | 6/1992 | McNamara | 248/545 |
| 5,143,108 | 9/1992 | Kenney | 135/16 |
| 5,323,991 | 6/1994 | West | 248/121 |
| 5,390,884 | 2/1995 | Skoff et al. | 248/156 |
| 5,746,031 | 5/1998 | Burns | 52/170 |

FOREIGN PATENT DOCUMENTS

| | | | |
|---|---|---|---|
| 461353 | 7/1947 | Canada | 47/47 |
| 367675 | 11/1906 | France | 47/47 |
| 673007 | 1/1930 | France | 47/47 |
| 78931 | 4/1894 | Germany | 47/47 |
| 3305337 | 8/1984 | Germany | 47/47 |
| 272589 | 10/1989 | Germany | 47/47 |
| 313911 | 1/1934 | Italy | 47/47 |
| 126328 | 2/1959 | U.S.S.R. | 47/47 |
| 3798 | 8/1882 | United Kingdom | 47/47 |
| 15885 | 12/1892 | United Kingdom | 47/47 |
| 13272 | 5/1913 | United Kingdom | 47/47 |
| 210651 | 2/1924 | United Kingdom | 47/47 |
| 481376 | 3/1938 | United Kingdom | 47/47 |
| 663947 | 1/1952 | United Kingdom | 47/47 |

OTHER PUBLICATIONS

"This is a clematis tree", Sunset, William Aplin, Apr. 1965.

*Primary Examiner*—Michael J. Carone
*Assistant Examiner*—Fredrick T. French, III
*Attorney, Agent, or Firm*—Amster, Rothstein & Ebenstein

[57] ABSTRACT

An apparatus for holding potted plants with enhanced stability comprised of a pole or standard and a baseplate. The pole is passed through a hole in a square baseplate which conforms to the shape of the pole and is releaseably coupled to the baseplate. The baseplate is secured or attached to the ground by flanges formed by the corners of the baseplate. Thus, the baseplate acts to support or stabilize the pole when the apparatus is subjected to adverse environmental conditions.

12 Claims, 4 Drawing Sheets

TOP VIEW

SIDE VIEW

TOP VIEW

SIDE VIEW

APPARATUS WITH BASEPLATE FOR SUPPORTING A PLANT CONTAINER

BACKGROUND

The present invention relates to an apparatus for supporting plant containers, and more specifically to an apparatus for supporting plants or other devices comprised of a pole or standard which is inserted in the ground and a baseplate which is attached to the pole. The baseplate is affixed to the ground and acts to prevent the pole from twisting, leaning, or becoming dislodged from the ground when the apparatus is exposed to adverse environmental conditions. Such adverse environmental conditions may include over saturation of the ground due to excessive rain or excessive forces applied to the apparatus from severe winds.

Prior art plant stands or supports utilize poles or standards which are commonly inserted in soil, however these stands do not include baseplates for supporting the pole or standard in accordance with the present invention.

For example, U.S. Pat. No. 1,942,750 shows an apparatus comprised of a pole or standard with a wire ring supported from the top of the standard by cords. The base of the standard is provided with a plate which is adapted to rest upon the ground near the center of the plant to be supported.

U.S. Pat. No. 4,020,592 discloses a standard or pole for supporting a plant stem that is inserted through the soil contained in a flower pot. The pole is passed through a hole in the bottom of the flower pot and is received by a socket in dish shaped base in which the pot resides.

U.S. Pat. No. 4,213,272 shows a apparatus consisting of several horizontally oriented plates, the bottom plate resting upon the ground. Star shaped holes are located in the center of the plates so that a vine can grow upwardly through the holes. The plates are aligned by holes located near the edge of the plates through witch stakes are inserted. These poles extend through the bottom plate and are inserted in the ground.

U.S. Pat. No. 4,584,792 shows a plant support comprised of a pole with associated base cross members. The cross members are shown to be included in flower pot below the surface of the soil. In order to associate the support with a plant, the support must be placed in the pot concurrently with the plant. Disassociating the support from the plant requires soil to be removed from the pot which could potentially damage the plant's roots.

U.S. Pat. No. 3,554,473 although not related to a plant holding apparatus shows a portable base for supporting reflectors or signs mounted on standards. The standard is passed through several circular frame members installed in a cylindrical container which in turn is filled with a high density material such as sand or gravel or a solidifying material such as concrete. Once assembled, the standard and frame members cannot be removed from the base without first removing the high density material from the container.

As the above descriptions illustrate, the prior art plant stands or supports by their very nature are limited in their utility. Prior art devices which do not include baseplates or include baseplates which are not affixed to the ground cannot withstand adverse environmental conditions. Additionally, prior art devices which require a portion of their structure to reside below the surface of the ground, are rather permanent in nature and cannot be readily relocated or disassociated from plants without uprooting or causing damage to the plant.

SUMMARY OF INVENTION

Accordingly, it is the objective of the present invention to provide an apparatus for holding plants or other devices having improved stability when subjected to adverse environmental conditions.

It is a further objective of the present invention to provide an apparatus for holding plants or other devices with improved stability which may be easily relocated and does not requiring the excavation of any structure associated with the apparatus which may result in damage to plants or destruction of surrounding lawn.

It is a further object of the present invention to provide an apparatus for holding plants or other devices which may be adaptable to various soil conditions by allowing the length of the portion of the pole protruding below the baseplate to be adjusted.

It is a further objective of the present invention to provide a baseplate for supporting a pole or standard that it is made from a single piece of a metallic compound thereby making the baseplate easy and cost effective to produce.

It is s further objective of the present invention to provide a baseplate for supporting a pole or standard that allows for the lawn surrounding the apparatus to be cut with a conventional lawn mower.

The above and related objects, features, and advantages of the present invention will be more fully understood by reference to the following detailed description of the presently preferred, albeit illustrative, embodiment of the present invention.

DETAILED DESCRIPTION OF THE PREFERRED EMBODIMENT

Figure 1:
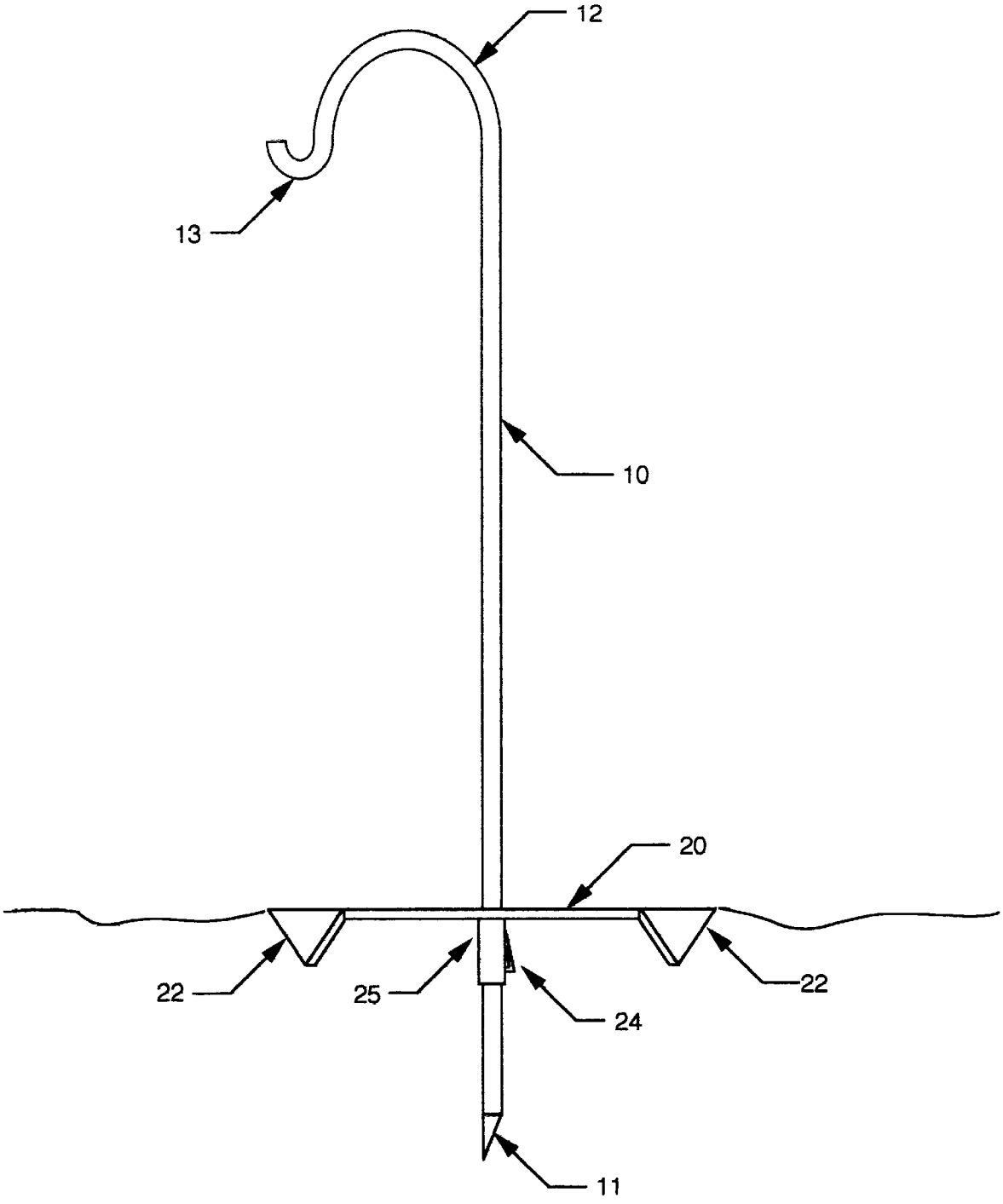
FIG. 1 is a pictorial representation of the preferred embodiment of the present invention as typically installed.

With reference to FIG. 1, the preferred embodiment of the present invention is shown to include a pole or standard 10 that is cross sectionally square. One end of the pole is tapered 11 to form a point so that the pole can be readily inserted into the ground. The other end of pole 10 is formed into several opposing arcs 12 and 13 of approximately one hundred and eighty degrees. Thus, the overall shape of this end of pole 10 resembles that of a "sheeps hook". Upwardly facing arc 12 provides the means from which a plant or other device may be hung.

Pole 10 also includes a series of predrilled holes (not shown), typically one quarter inch in diameter, beginning near the tapered end of the pole 11 and extending up pole 10 towards arcs 12 and 13. These predrilled holes in conjunction with snap button 24 allow for the length of pole 10 projecting below the baseplate 20 to be adjusted.

Figure 2:
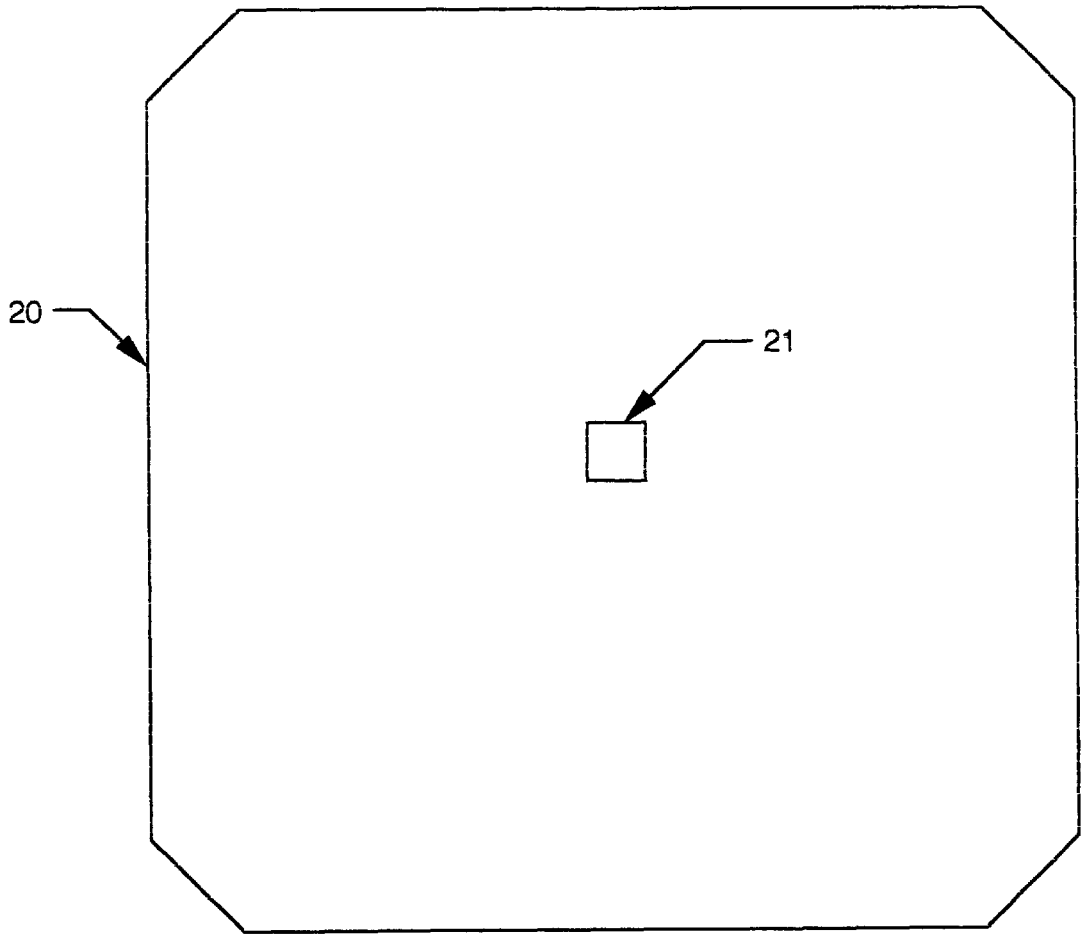
FIG. 2 is a pictorial representation of the preferred embodiment of the baseplate of the present invention.
Figure 2:
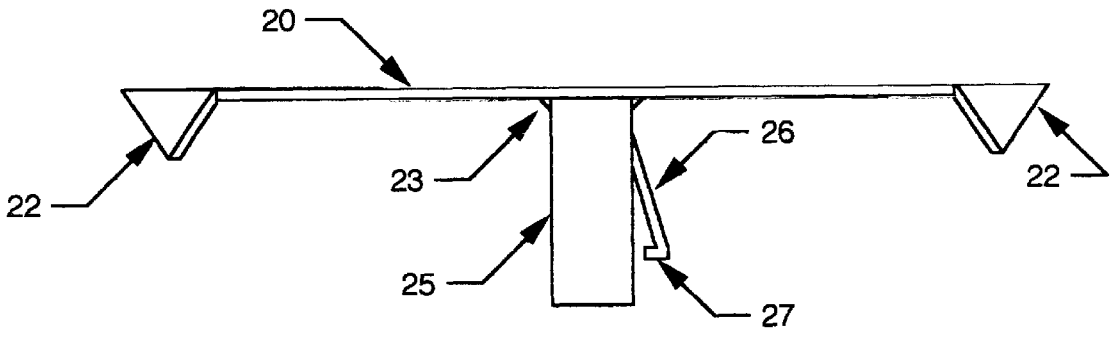

A detailed drawing of the preferred embodiment of the baseplate 20 is shown in FIG. 2. In its preferred embodiment baseplate 20 is approximately six inches square and is made from a one eighth inch thick steel plate. Four flanges 22 are formed by bending each of the four corners of baseplate 20 downward such that the resulting flanges are right angle isosceles triangles with sides approximately one inch in dimension. The flanges 22 are bent to the point where they are perpendicular to the horizontal surface of the baseplate 20. It will be appreciated that flanges 22 are therefore pointed which allows them to be easily inserted into the ground. By forming the flanges 22 in this manner, the time to produce the baseplate is reduced since flanges need not be produced independently and subsequently attached to the baseplate.

Square hole 21 is located in the center of the baseplate and is dimensioned to conform to the cross sectional dimensions of the pole 10. Tubing 25 of approximately two and one half inches in length is affixed to the underside of baseplate 20 by welding 23 around the perimeter of tubing 25. Tubing 25 is positioned to be coincident with square hole 21 and is also dimensioned to generally conform to the cross sectional dimensions of pole 10. It will be appreciated that hole 21 in conjunction with tubing 25 form a sleeve through which pole 10 can pass.

Attached to tubing 25 is snap button 24 comprised of a flexible member 26 and pin 27. Snap button 24 is located such that pin 27 is coincident with a hole (not shown) in tubing 25 generally conforming to the cross sectional shape of pin 27. The flexible member 26 of snap button 24 acts to insert pin 27 through the hole in tubing 25. Pin 27 can be extracted from the hole by applying force in the opposite direction of the force applied by flexible member 26.

When the apparatus is assembled, pin 27 is temporarily extracted from the hole in square tubing 25. Pole 10 is positioned such that the surface with the series of predrilled holes is facing the surface of tubing 25 which includes snap button 24. The tapered end 11 of pole 10 is passed through hole 21 and tubing 25 until the desired length of the pole 10 is protruding below the horizontal surface of baseplate 20. Snap button 24 is then released and pin 27 is inserted through the hole in tubing 25 and through a corresponding predrilled hole in pole 10. The length of the pole 10 extending below baseplate 20 can be adjusted by applying a force flexible member 26 on snap button 24 such that pin 27 is removed from the hole in tubing 25 and a corresponding predrilled hole in pole 10. Pole 10 is then repositioned with respect to baseplate 20 until the desired length of pole below the baseplate is attained. Snap button 24 is released and pin 27 is inserted through hole in tubing 25 and a corresponding predrilled hole in pole 10. When assembled, baseplate 20 is mechanically coupled to pole 10 such that baseplate 20 is generally perpendicular to pole 10. It will be appreciated by those skilled in the art that a latching device other than the snap button described herein can be used to releaseably couple pole 10 baseplate 20.

The apparatus is installed by inserting tapered end 11 of pole 10 into the ground or soil. As flanges 22 of the baseplate 20 come into contact with the ground, baseplate 20 is affixed to the ground by applying force to its upper surface thereby inserting flanges 22 into the ground. By increasing the surface area in which a force acting to dislodge the apparatus must operate, baseplate 20 helps prevent the apparatus from leaning or becoming dislodged from the ground. Additionally, because the flanges 22 are located symmetrically around pole 10, baseplate 20 acts to support the apparatus from an external force applied from any direction. The increased support provided by baseplate 20 allows the apparatus to remain standing when subjected to adverse environmental conditions when apparatuses without such baseplate would become dislodged and fall over. Also, because baseplate 20 when installed rests flat on the ground, surrounding lawn can be easily cut with a standard mower.

The invention is of course not in any way restricted to the preferred embodiment described above, and several possibilities of modifications thereof would be apparent to a man skilled in the art without departing from the basic idea of the invention.

Figure 3:
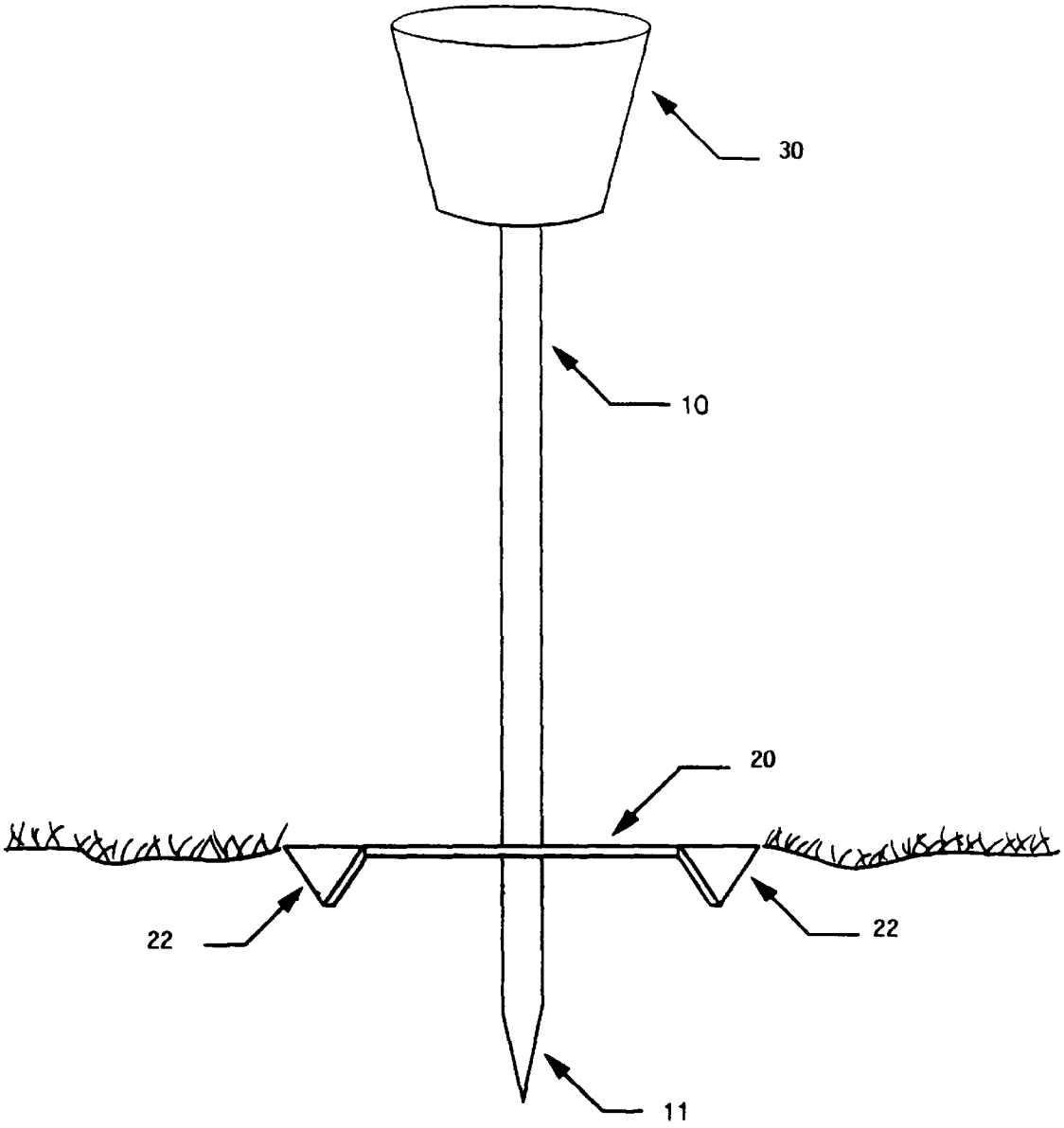
FIG. 3 is a pictorial representation of a second embodiment of the present invention as typically installed.
Figure 4:
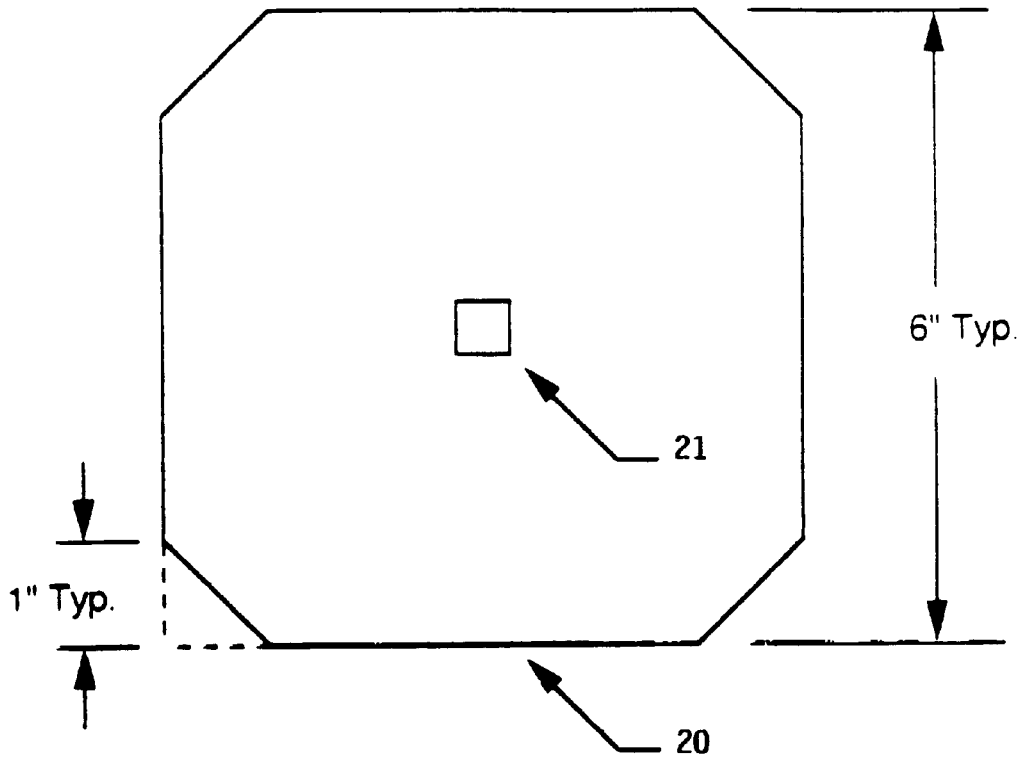
FIG. 4 is a pictorial representation of a second embodiment of the baseplate of the present invention.
Figure 4:
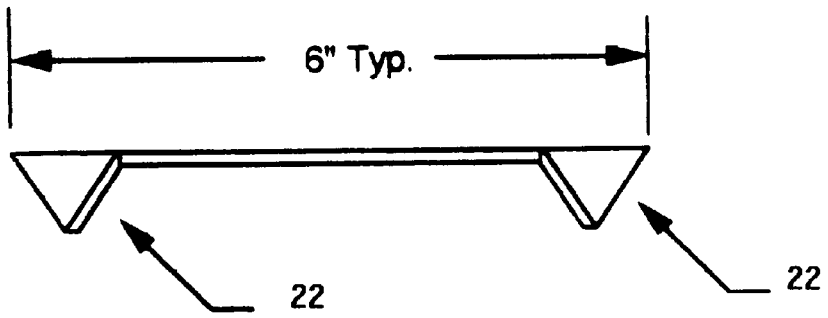

For example, as shown in FIG. 3, baseplate 20 can be permanently secured to pole 10 in any conventional manner such as welding the two pieces together. While in such an embodiment the length of pole 10 protruding below the bottom surface of baseplate 20 is fixed, the length can be selected during assembly to accommodate a variety of different soil and load conditions. As shown in FIG. 4, in such an embodiment tubing 25 and snap button 24 need not be included as integral parts of baseplate 20.

Additionally, the means for receiving the plant or other device need not be comprised of the "sheep's hook" depicted in FIG. 1 and may, for example, be comprised of a cross member with hooks from which several plants could be hung. Additionally, as shown in FIG. 3, a receptacle 30 for holding a potted plant may be attached to the end of pole 10. The receptacle may be cylindrical in shape thereby generally conforming to the shape of typical plant pots and so dimensioned such that a standard dimensioned plant pot can be easily placed therein. Furthermore, the means for receiving plants could be modified so that an object other than a plant can be associated with the pole.

Additionally, baseplate 20 is not limited in its application to plant stands or plant holders. Baseplate 20 can be used with other horticultural devices and can, for example, be used to support sprinklers that are attached to poles or standards. Examples of additional non-horticultural applications of the baseplate 20 include supporting temporary sign posts, flag masts, and tent or canopy poles.

Furthermore, the size of the baseplate can be varied to accommodate space and load requirements, and the shape of the baseplate may be modified to be rectangular, triangular, or other desired shape. Additionally, the number, location, and dimensions of the plurality of flanges can be varied according to the shape of the baseplate and load requirements. Likewise, the shape of the hole and tubing may be modified to conform to a variety of different cross sectionally shaped poles or standards. Furthermore, the location of the hole and tubing need not be located in the center of the baseplate, and multiple holes and associated tubing may be included in a single baseplate for association with multiple poles or standards.

While the preferred embodiment is for the baseplate to made of one eighth inch thick steel, the baseplate can be made of any suitable material of any suitable thickness, and the contour of the baseplate may also be modified so that it may be used on a surface that is not generally flat.

Various additional modifications and improvements thereon will become readily apparent in those skilled in the art. Accordingly, the spirit and scope of the present invention is to be construed broadly and limited only by the appended claims, and not by the foregoing specification.

I claim:

1. An apparatus for supporting a plant container comprising:

(a) a pole;

(b) a baseplate having an upper surface and a lower surface;

(c) said base plate having a hole generally conforming to the cross sectional shape of said pole, tubing having means for releasable coupling said baseplate to said pole attached to said lower surface of said base plate coincident with said hole and generally conforming to the cross sectional shape of said pole, and a plurality of flanges securing said base plate to the ground; and (d) one end of said pole protruding through said hole and said tubing in said baseplate, wherein one end of said pole and said tubing are inserted into the ground, another end of said pole having means for supporting a plant container.

2. The apparatus according to claim 1 wherein said means for releaseably coupling said baseplate to said pole comprises a pin inserted through a hole in said tubing and through a hole in said pole.

3. The apparatus according to claim 1 wherein said means for releaseably coupling said baseplate to said pole comprises a snap button.

4. The apparatus according to claim 1 wherein said baseplate is square in shape.

5. The apparatus according to claim 1 wherein said plurality of flanges are located near the corners of said square baseplate.

6. The apparatus according to claim 5 wherein said plurality of flanges are perpendicular to said baseplate.

7. The apparatus according to claim 1 wherein said hole in said baseplate is located approximately in the center of said baseplate.

8. The apparatus according to claim 1 wherein said pole is cross sectionally square.

9. The apparatus according to claim 1 wherein said baseplate is made of a pliable metallic compound.

10. An apparatus for supporting a plant container comprising:

(a) a pole having a first tapered end and a second shaped end having a downwardly facing arc and an upwardly facing arc;

(b) a baseplate having an upper surface and a lower surface and comprising a hole generally conforming to the cross sectional shape of said pole, tubing attached to said lower surface of said baseplate coincident with said hole and generally conforming to the cross sectional shape of said pole, and a plurality of downwardly facing flanges; and (c) said tapered end of said pole, said tubing having means for releasably coupling said pole to said baseplate, and said plurality of downwardly facing flanges being inserted in the ground, and said upwardly facing arc of said shaped end of said pole providing means from which a plant container can be suspended.

11. The apparatus according to claim 10 wherein said means for releaseably coupling said baseplate to said pole comprises a pin inserted through a hole in said tubing and through a hole in said pole.

12. The apparatus according to claim 10 wherein said means for releaseably coupling said baseplate to said pole comprises a snap button.

* * * * *